US006273255B1

(12) United States Patent
Rösler

(10) Patent No.: US 6,273,255 B1
(45) Date of Patent: Aug. 14, 2001

(54) HOLDING DEVICE FOR HANGING TOOLS

(76) Inventor: Peter Rösler, Ifenweg 3, 88239 Wangen (DE)

( * ) Notice: Subject to any disclaimer, the term of this patent is extended or adjusted under 35 U.S.C. 154(b) by 0 days.

(21) Appl. No.: 09/518,595

(22) Filed: Mar. 3, 2000

(51) Int. Cl.[7] ..... B65D 73/00; B65D 85/20
(52) U.S. Cl. ..... 206/378; 211/70.6
(58) Field of Search ..... 206/378; 248/309.1, 248/309.2, 313, 316.8; 211/70.6

(56) References Cited

U.S. PATENT DOCUMENTS

| | | | | |
|---|---|---|---|---|
| 4,987,998 | * | 1/1991 | Tsai | 206/372 |
| 5,425,519 | * | 6/1995 | Budert | 248/214 |
| 5,725,107 | * | 3/1998 | Dembicks | 211/70.6 |
| 5,740,911 | * | 4/1998 | Chou | 206/378 |
| 5,848,694 | * | 12/1998 | Newton | 206/373 |
| 5,855,284 | * | 1/1999 | Dembicks | 211/70.6 |
| 6,070,745 | * | 6/2000 | Dembicks | 211/70.6 |

* cited by examiner

*Primary Examiner*—Ramon O. Ramirez
*Assistant Examiner*—Jon Szumny
(74) *Attorney, Agent, or Firm*—Cohen & Grigsby, P.C.

(57) ABSTRACT

A holding device designed in one piece for hanging up tools is provided with a holding strap and a receiver with at least two elastically springing receiving wings spaced apart from each other, whereby on the contact surfaces of the receiving wings facing the tool, numerous elastically springing barbs are arranged. A relatively economical and lightweight holding device for tools can be made available owing to its one piece design which is nonetheless stable and reliable in holding the tool through a combination of frictional engagement and form fit. The receiving wings are preferably arranged on a receiving plate connected to a holding strap, whereby stabilizing ribs, possibly connected to the base plate, can be provided between the receiving wings. The holding device is universally applicable for all types of tools with openings located on their interior, with or without catching grooves, or for support on the outer surface of the tools.

13 Claims, 3 Drawing Sheets

HOLDING DEVICE FOR HANGING TOOLS

CROSS-REFERENCE

This application claims priority under 35 U.S.C. 119 to German Patent Application No. 29903874.2.

FIELD OF THE INVENTION

The current invention concerns a holding device for hanging up tools. Such holding devices for tools are already familiar and numerous in the state of the art, and have, in addition to the actual holding device for the tool, a loop-shaped hanging device for hanging on a stand or such similar object.

BACKGROUND OF THE INVENTION

With U.S. Pat. No. 5,740,911, a two piece hanging device for tools became known, specifically for ratchets, whereby the first piece consists of a suspension attachment secured to a base plate with a hollow, cube-shaped receiver for engagement into the ratchet side opening of a hexagon socket. The second piece is composed of a base plate, and secured to it, a cuboid piece with a catch projection, whereby this second piece engages into the hexagon hole and is supported at the bottom there with the base plate, engages in the hollow space of the cube-shaped part of the first piece and catches with the catch projection on the first piece. Thus, the tool is penetrated from both sides by the first and the second piece of the holding device and both pieces catch separably. The disadvantage of this design form is that two different pieces are required which are relatively expensive in design, bear considerable weight and are difficult to disassemble.

Exhibiting two pieces as well, is the holding device as per U.S. Pat. No. 5,425,519 whereby there, secured to a holding strap is a tongue with an undercut which, like a catch spring, engages into the actual receiver for the tool, whereby the receiver exhibits additional catch knobs for catching into the corresponding opening of the tool. Once again, the disadvantage here is that two different pieces exist, exhibiting relatively complex shapes, and a secure hold of the tool is not ensured because relatively few catch knobs are available on the receiver for catching in the opening of the tool which for the purpose of a secure hold must exactly catch into the corresponding recesses in the opening of the tool.

With U.S. Pat. No. 4,941,571, a holder for socket wrenches also became known in which disc shaped receiving lamina are set up along a receiving strip by clamping down onto corresponding bases. The socket wrenches are then set up on these receiving lamina by their opening intended for the tool holder. These receiving lamina are respectively divided into two halves, springing elastically toward one another, by a slit into which the base of the receiving strip catches for support. Owing to the elastic shape alteration of this receiving lamina inside the opening on the side of the socket wrench, the tool is secured by the squeezing effect. Once again, the disadvantage here is a design with several parts and likewise, no secure hold is ensured because there is no catch between the holding element and the tool, but rather simply frictionally engaged sticking, and furthermore these receiving lamina do not exhibit any reliable stability.

With U.S. Pat. Nos. 5,725,107 and 5,715,951, a three piece holding element for tools became known which is comprised of a hanging strap, a gripping element with a hand lever and a support strip. Initially, the slit gripping element is reshaped elastically by a hand lever such that it can catch into a corresponding opening in the tool and spread itself in there by frictionally engaged support, whereby the gripping component is introduced into a receiving strip in order to secure this frictionally engaged contact. Once again, the disadvantage here is the complicated, multiple piece design and no secure hold is ensured due to the frictionally engaged sticking.

With U.S. Pat. No. 4,421,230, a one piece holding device for tools became known, which is in fact produced with three separate parts bonded together, more specifically a base plate, a cover plate with boreholes and an intermediate layer with support stubs which penetrate through the holes on the cover plate. The support elements can be designed to spring and have just a few catch projections on their upper free extremity or just a few catch edges running in a circle along the cover of a cylinder. The disadvantage here is once again, that although the design is of one piece, it must be manufactured from three pieces in a complex manner (bonded together) and because of this, the entire construction is relatively expensive and accordingly, the weight is relatively high as well. Another disadvantage here, is that either a frictionally engaged contact exists or the catch elements must exactly engage in the corresponding grooves in the tool openings for which a secure hold is not ensured here. Furthermore, in the event one of these catch projections breaks off, the holding device can become detached. A hanging strap is not provided here.

A very simple holding device for tools with square drive holes is also known whereby here, a holding strap is simply secured to a receiving cube exhibiting corresponding catch projections on its lateral surface which engage and catch into the grooves inside the opening of the tool. The one-piece design of this holding device makes it economical and easy to produce, however a secure catch between the receiving part and the tool is only possible to a limited extent, because the catch projections of the holding device must catch exactly aligned with the notches on the tool and also, if a catch projection breaks, support is no longer ensured.

Therefore, it is the task of this invention to further develop the above described state of technology of the holding device for hanging up tools such that the holding device is now easy and inexpensive to develop, yet in spite of this, it ensures stable and reliable support for the tool even in the event of a partial defect in the holding device. This holding device is intended to easily adapt to and be removed from the tool and can be used more than just once.

SUMMARY OF THE INVENTION

In a preferred embodiment of the present invention, the holding device for hanging up tools is designed in one piece and comprises a receiver composed of at least two receiving wings, spaced apart from each other, and elastically springing toward one another, whereby on the contact surfaces of the receiving wings facing the tool, numerous springing elastic barbs are arranged. This configuration provides a relatively economical and lightweight holding device for tools is available based on a one piece design which, in spite of this, can still hold the tool in a stable and reliable manner. This is made possible by the numerous barbs running along the tool-side surface, whereby the tool is held partially by frictional engagement and partially by form-fit, depending on the individual composition of the workpiece.

In a preferred design version of the invention, it is provided that the receiver consists of two mutually opposite receiving wings with parallel, strip-shaped barbs; these receiving wings are arranged perpendicular on a corresponding receiving plate which in turn is connected to a hanging strap. In a preferred embodiment, the barbs are triangle-shaped in cross section and in the form of strips basically run parallel to the receiving plate or to the lower surface of the receiving wings. Other cross section shapes can be provided such as circular shapes or right angle shapes and the barbs can also run arbitrarily along the surface of the receiving wings, and not necessarily parallel to the receiving plate. It is also conceivable to provide many small pegs or pyramids as barbs on the surface of the receiving wings. A great number of springing elastic barbs is provided on the tool-facing contact surface of the equally springing elastic receiving wings.

Preferably, between the receiving wings at least one springing elastic stabilizing rib is provided. The latter can run vertical to the receiving wings for example and can be provided over the entire height of this receiving wing. It is also possible that respectively one stabilizing rib is provided per receiving plate, which stabilizing ribs are not directly connected to each other and are secured to the base plate. For this, it is preferable that the stabilizing rib exhibits its greatest dimension on the base plate and tapers in the direction of the free end of the receiving wings so that the stabilizing rib runs into the receiving wing on the free end of the receiving plate.

It is also possible to provide several stabilizing ribs between the receiving plates which can be connected to one another, and these stabilizing ribs need not necessarily run perpendicular to the receiving wings and need not be present over the entire height of the receiving wings.

In a second design version of the current invention, no stabilizing ribs are present, but nonetheless still at least two springing elastic receiving wings with springing elastic barbs. This is provided for lighter weight tools for which the binding power between the receiving wings can be lesser than for heavier tools.

The use of several receiving wings offers the advantage that pyramid-shaped, polygonal or round openings in the tools can also be better accommodated by the holding device than by other holding devices with only two receiving wings, and/or that an intensification of the securing link can thereby be achieved, which is specifically desirable for heavy tools.

It is also provided that two or more specially shaped receiving wings are made available for round openings in tools, for which at least the contact surfaces of the receiving wings are formed as arc-shaped toward the direction of the opening wall of the tool. Even all of the receiving wings, including the catching hooks can be arc-shape formed.

Hereby, it is also possible to simply provide two receiving plates which are at least fundamentally arc-shaped on their contact surfaces toward the opening of the tool; but there can even be three, four or several receiving plates provided which are all designed to spring.

It is an advantage of the invention that the receiving wings are secured to the receiving plate in a springing manner and that they are equipped with numerous barbs on the contact surface in the direction of the opening of the tool and that these barbs lay as elastically shapeable on the surface of the tool, and also even possibly catch into the grooves and openings that are present.

Owing to this, a combination of frictional engagement and form-fitting contact between the holder and the workpiece is achieved, and due to the great number of barbs, one or several of the barbs may be defective without fundamentally impairing the holding device in accordance with the invention.

The entire holding device is preferably constructed of plastic, specifically of recyclable polypropylene.

The holding device in accordance with a preferred embodiment of the invention is also universally applicable for all types of tools with openings located on their interior, without or without catching grooves, whereby the openings on the tools can exhibit any desired shape. The following examples relate to holding devices for socket wrenches, that is, tools with openings located on their interior.

Other advantages of the present invention will become apparent by a perusal of the following detailed description of a presently preferred embodiment of the invention taken in connection with the drawings.

BRIEF DESCRIPTION OF THE DETAILED DRAWINGS

Figure 4A:
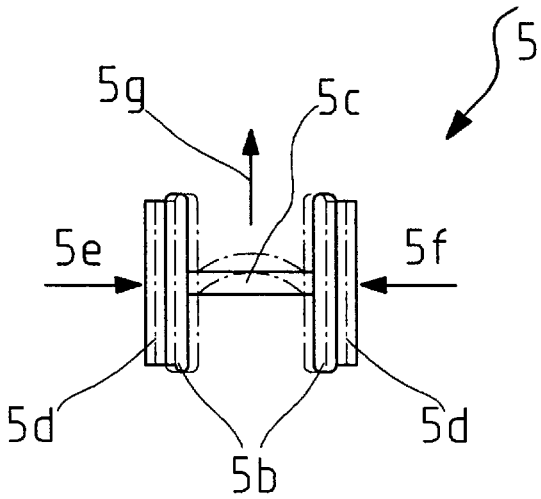
Figure 4B:
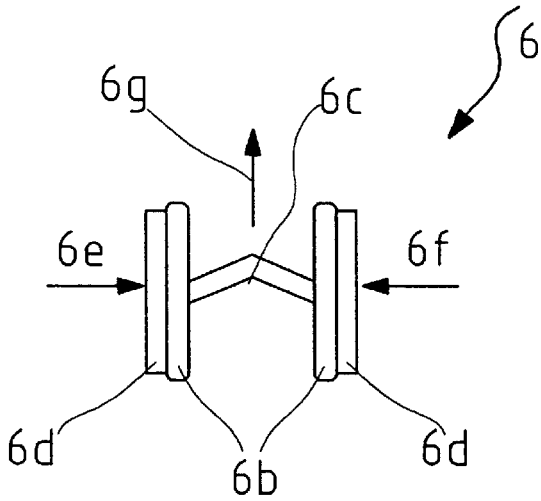
Figure 4C:
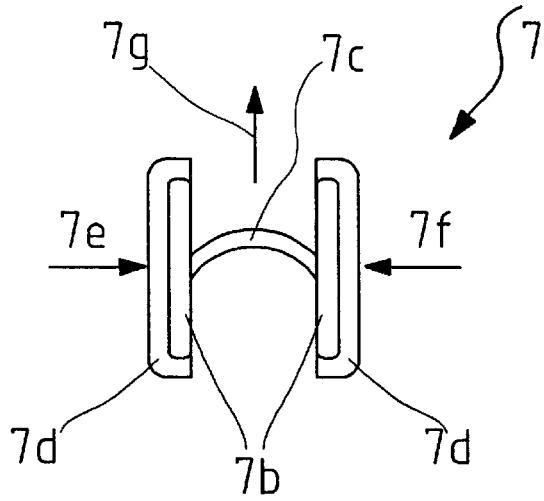
Figure 5A:
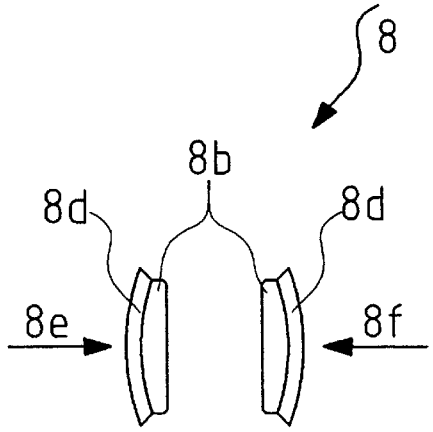
Figure 5C:
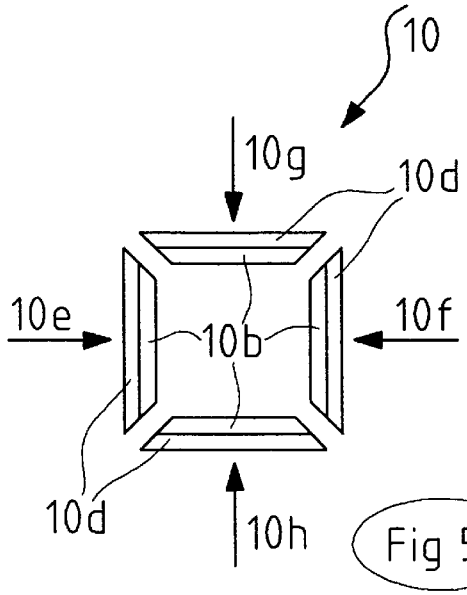
Figure 5D:
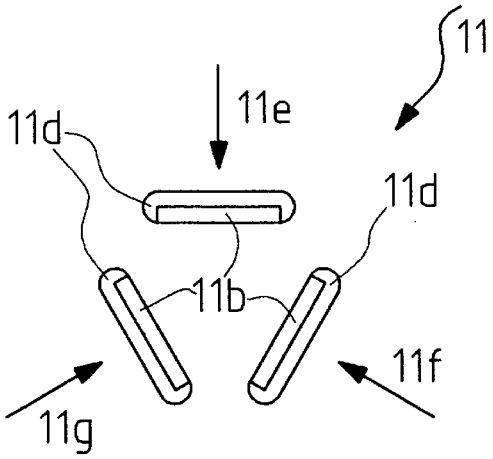
Figure 5B:
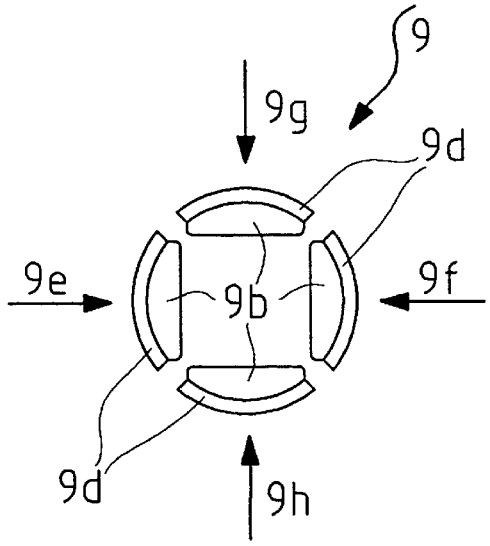

FIGS. 4*a*–4*c* show various types of design versions of the holder in accordance with a preferred embodiment of the invention in an under view with stabilizing ribs and two receiving plates, whereby the holding strap is not represented here;

FIGS. 5*a* and 5*b* show holding devices in accordance with a preferred embodiment of the invention with two or four arc-shaped receiving plates in cross section, without stabilizing ribs in an under view without representation of the holding strap;

FIGS. 5*c* and 5*d* show a holding device in accordance with a preferred embodiment of the invention with three or four receiving plates without stabilizing ribs, whereby the holding strap is again not represented here.

DETAILED DESCRIPTION OF THE PRESENTLY PREFERRED EMBODIMENTS

Figure 1:
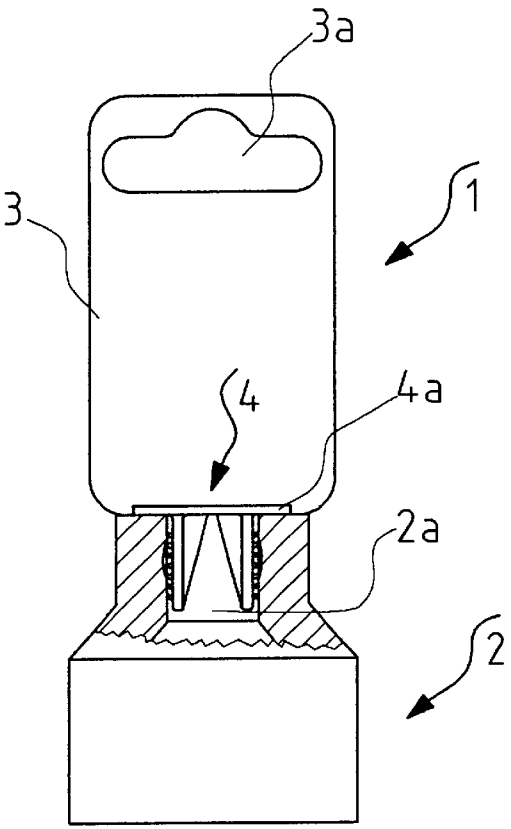
FIG. 1 shows a holding device in accordance with a preferred embodiment of the invention with a supported tool (e.g. hexagon socket or socket wrench)

In FIG. 1, the holder 1 in accordance with a preferred embodiment of the invention is represented, whereby the tool 2 is represented in the lower area and is held by the receiver 4 of the holder 1. The tool 2 can be hung by means of a holding strap 3 of the holder 1 to a presenting stand or such similar object, and specifically via the opening 3*a*. The receiver 4 of the holder 1 engages thus into the opening intended for the tool holder or into the ratchet side opening 2*a* of the hexagon socket/socket wrench 2, whereby the opening 2*b* remains open for a fastening element (e.g. screw).

Figure 2:
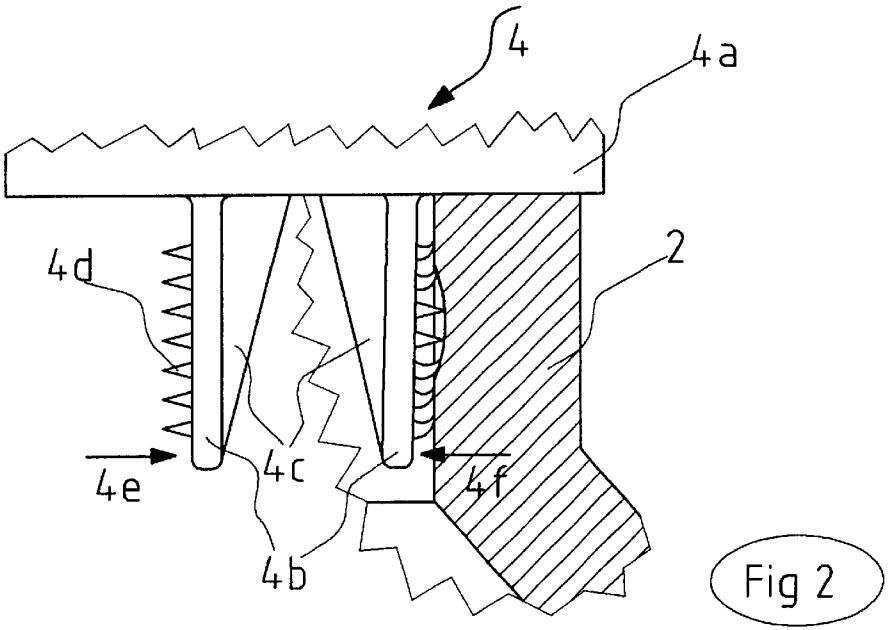
FIG. 2 shows an enlarged detail of the holding device in accordance with a preferred embodiment of the invention in the area of contact between the holder and the tool.

In FIG. 2, an enlarged detail of the receiver 4 is represented, thus the contact area between the holder 1 and the tool 2. The receiving plate 4*a*, which is arranged at a right angle relative to the holding strap 3, has secured on its underside, turned away from the holding strap 3, the receiving wings 4*b* to which and upon which the stabilizing ribs 4*c* are respectively vertically located. The stabilizing ribs 4*c* are located on the side of the receiving wings 4*b* which forms the contact surface facing in the direction of the tool. The stabilizing ribs 4*c* cover the entire height of the receiving wings 4*b* in this embodiment; they are not connected with the stabilizing rib 4*c* of the other receiving wing 4*b* and they taper off toward the free extremity of the receiving wing 4*b*.

On the outer face of the receiving wing 4*b*, thus on the contact surface for the tool 2, are located the barbs 4*d*, also basically running along the entire surface of the receiving wings 4*b* and somewhat parallel to the receiving plate 4*a*. The receiving wings 4*b* are designed to spring elastically and they can be moved toward one another or from one another in the moving directions 4*e* and 4*f* in an elastically springing manner, more specifically during introduction into the corresponding opening 2*a* of the tool 2 intended for the tool holder.

Figure 3:
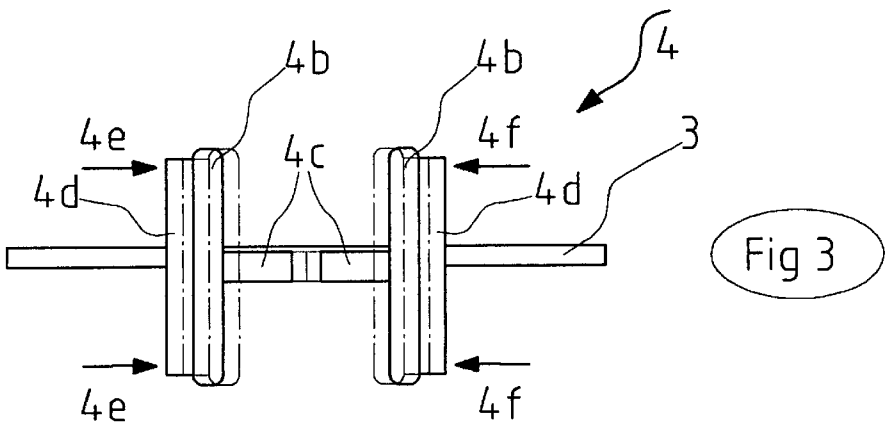
FIG. 3 shows an under view of the holding device in accordance with a preferred embodiment of the invention.

In FIG. 3, an under view of the receiver 4 as per FIGS. 1 and 2 can be seen, whereby the dashed-dotted lines represent the receiving wings 4*b* and the barbs 4*d* in a spring deflection state. The receiving wings 4*b* can thus move with springing action in the moving directions 4*e* and 4*f* and during introduction into the tool opening 2*a*, they then assume the positions which are represented by the dashed-dotted lines. As in FIG. 2, the stabilizing ribs are also designated by 4*c* here, the holding strap by 3, whereby the receiving plate 4*a* is not represented.

In FIGS. 4*a* through *c*, the under views corresponding to receivers 5–7 are represented, similar to the under view of receiver 4 represented in FIG. 3, whereby here however, the additional representation of the holding strap 3 was abandoned.

In these FIGS. 4*a* through 4*c*, various shaped stabilizing ribs 5*c*, 6*c*, 7*c* are represented which are rectangular (FIG. 4*a*), arrow-shaped (FIG. 4*b*) or arc-shaped (FIG. 4*c*) in cross section. In FIG. 4*a*, receiver 5 is thus represented with two receiving wings 5*b* spaced apart from one another and with barbs 5*d* secured on them, whereby both receiving wings 5*b* are connected to each other via a perpendicular somewhat centrally located stabilizing rib which can run over the entire surface of the receiving wing 5*b*. When introducing the receiver 5 into the opening 2*a* of the tool 2 intended for the tool holder, the receiving wings 5*b* with the barbs 5*d* will be moved toward each other in the moving directions 5*e* and 5*f* and the respective stabilizing rib 5*c* is dimensioned such that it gives springing elastically upward in the moving direction 5*g* in FIG. 4*a* and thus supports the springing action of the receiving wings 5*b*.

In FIG. 4*b*, in between the receiving wings 6*b* with barbs 6*d* mounted on them, there is now an arrow-shaped stabilizing rib 6*c* provided about in the middle of them, whereby when applying force or when putting in place the receiver into the opening 2*a* of the tool 2, the receiving wings 6*b* are moved toward one another in the arrow directions 6*e* and 6*f* so that the stabilizing rib 6*c* gives upward in the arrow direction 6*g*.

In FIG. 4*c*, a receiver 7 is also described again with its corresponding two receiving plates 7*b*, whereby the barbs 4*d* are not simply mounted on the outer contact surfaces of the receiving wings 7*b* toward the opening of the tool as in the above named FIGS. 4*a* and 4*b*, but rather also on the end face surfaces. Both stabilizing ribs 7*c* will again be moved toward one another in the moving directions 7e and 7f when introducing the receiver 7 into the opening 2*a* of the tool 2 and the stabilizing rib 7*c* gives upward in an elastic springing manner.

FIGS. 5*a* through 5*d* show exemplary designs of receivers 8–11 from an under view however without any constructive stabilizing ribs present, whereby the holding strap 3 and the holding plates 8*a*–11*a* are not represented. In FIG. 5*a* are two receiving wings 8*b* with arc shaped barbs 4*d* mounted on them, whereby these receiving wings 8*b* can also be moved toward one another in an elastic springing manner in the moving directions 8*e* and 8*f* in order to squeeze the tool 2 inside its opening 2*a* in an elastic springing manner.

FIG. 5*b* basically shows a similar arrangement of a receiver 9, such as in FIG. 5*a*, however here instead of the two provided, there are four receiving wings 9*b* with arc-shaped barbs 9*d* mounted on them which then move toward one another, in the moving directions 9*e*, 9*f*, 9*g* and 9*h*, respectively converging to the center of the receiver 9 when introducing into the opening 2*a*.

FIGS. 5*c* and 5*d* show other exemplary designs of the holder 10, 11, without stabilizing rib, with more than two receiving wings 10*b*, 11*b*, whereby the holding strap 3 and the receiving plate 10*a*, 11*a* are also not represented.

FIG. 5*c* shows four non-interconnected receiving wings 10*b* which are basically arranged in a quadriform relation to each other on the receiving plate 10*a*, whereby these once again bear barbs 10*d* facing outward in the direction of the tool 2. When introducing the receiver 10 into the opening 2*a* of the tool 2, once again the receiving wings 10*b* are moved toward each other, in the moving directions 10*e* through 10*h*, toward the center of the arrangement and they clamp the tool 2 once again in an elastic springing manner with the support of the barbs 10*d*. The end face delimiting surfaces of the receiving wings 10*b* have a miter of about 45° so that during spring deflection they do not hinder each other in their converging movement.

FIG. 5*d* shows an arrangement of receiver 11 with three different receiving wings 11*b* secured to the receiving plate 11*a* (not represented), more specifically for openings 2*a* of the tool 2 with a triangle shaped cross section, whereby the three receiving wings 10*b* once again exhibit on their contact surfaces toward the tool 2 the barbs 11*d* which are also present on the end face and these receiving wings 11*b* converge inwards toward the center, in an elastic springing manner, in the moving directions 11*e*, 11*f* and 11*g* during introduction of the receiver 11 into the opening 2*a* of the tool 2.

While presently preferred embodiments of the invention have been shown and described in particularity, the invention may be otherwise embodied within the scope of the appended claims.

What is claimed is:

1. A holding device for hanging a tool comprising a holding strap and receiver whereby the holding device is designed in one piece and engages into an inner opening of the tool and the receiver is comprised of at least two elastically springing receiving wings spaced apart from one another, wherein a plurality of elastically springing barbs are arranged to bend against the direction of introduction of the holding device into the opening of the tool in a frictionally engaged gripping and a spring-actuated supportive manner along substantially a gripping length of a contact surface of the receiving wings facing the tool.

2. The holding device for hanging tools according to claim 1, wherein the receiving wings are arranged on a receiving plate in a substantially vertical orientation, whereby the receiving plate is connected to the holding strap.

3. The holding device for hanging tools according to claim 1 or 2, wherein the barbs are aligned substantially parallel to the receiving plate.

4. The holding device for hanging tools according to claim 3, wherein the barbs are comprised of a triangular shaped cross section.

5. The holding device for hanging tools according to claim 4, wherein at least the barbs of the receiving wings are comprised of an arc shaped cross section.

6. The holding device for hanging tools according to claim 5, at least the connective surface of the receiving wings are comprised of an arc shaped cross section.

7. The holding device for hanging tools according to claim 6, wherein barbs are also provided on the end faces of the receiving wings.

8. The holding device for hanging tools according to claim 7, wherein barbs are not located on the end face at the free end of the receiving wings.

9. The holding device for hanging up tools according to claim 8, wherein at least one elastically springing stabilizing rib is provided between the receiving wings.

10. The holding device for hanging tools according to claim 9, wherein the elastically springing stabilizing ribs are arranged substantially vertical to the receiving wings.

11. The holding device for hanging tools according to claim 10, wherein thus the elastically springing stabilizing ribs are connected to the base plate.

12. The holding device for hanging tools claim 11, wherein the elastically springing stabilizing ribs substantially span the height of the receiving wings.

13. The holding device for hanging tools according to claim 12, wherein no stabilizing ribs are provided between the receiving wings.

* * * * *